United States Patent [19]

Fugere et al.

[11] 4,198,708

[45] Apr. 22, 1980

[54] ELBOW/KNEE GUARD

[76] Inventors: Albert L. Fugere, 4901-17th Ave., Seattle, Wash. 98108; Michael J. Kelly, 808 NE. 82nd, Seattle, Wash. 98115

[21] Appl. No.: 917,516

[22] Filed: Jun. 21, 1978

[51] Int. Cl.[2] ..... A41D 13/06; A41D 13/08

[52] U.S. Cl. ..... 2/16; 2/24; 128/77; 128/80 C

[58] Field of Search ..... 2/24, 16, 161 R, 161 A; 128/80 C, 77

[56] References Cited

U.S. PATENT DOCUMENTS

| | | | |
|---|---|---|---|
| 1,081,245 | 12/1913 | McCall | 2/24 |
| 1,399,584 | 12/1921 | Shelton | 2/24 |
| 2,534,888 | 12/1950 | Vold | 2/24 |
| 3,189,919 | 6/1965 | Chase | 2/24 X |
| 3,216,417 | 11/1965 | Posey | 2/16 X |
| 3,463,147 | 8/1969 | Stubbs | 2/24 X |
| 3,911,497 | 10/1975 | Lewis et al. | 2/24 X |
| 3,934,583 | 1/1976 | Hollingshead et al. | 128/80 C |

*Primary Examiner*—Louis Rimrodt
*Attorney, Agent, or Firm*—Cole, Jensen & Puntigam

[57] ABSTRACT

The article is a combination of a protective pad, a cover element and two elastic strips. The protective pad is somewhat wider than it is long. The top and bottom edges of the pad are substantially straight, while the central portion of each side edge is cutaway, leaving two protrusions at the opposite ends of each side edge. The cutaway opening in each side edge extends a substantial distance into the pad, and a further keyhole-shaped opening, central of the cutaway opening, extends even further inwardly of the pad. The pad is covered with the stretchable fabric cover element, which follows generally the outline of the pad. The two strips of elastic connect the opposed side edges of the pad-cover combination at each end thereof, with the elastic strips being sufficiently short that they tend to draw the sides of the pad-cover combination toward each other, thereby curving the surface of the combination so that it will conform to the user's limb.

8 Claims, 7 Drawing Figures

Fig. 5
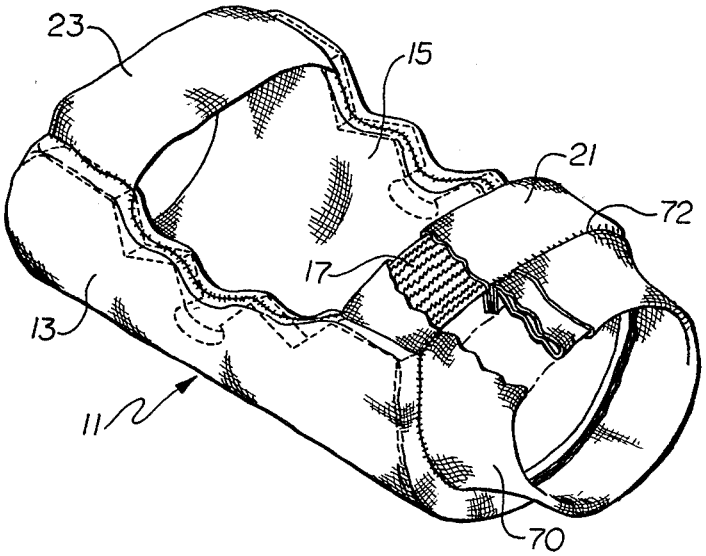
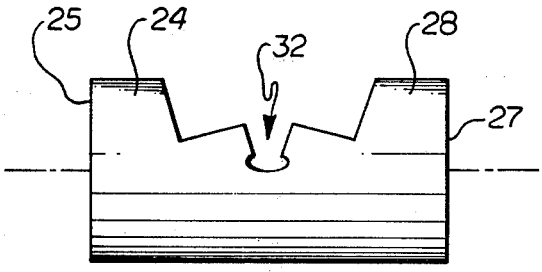
Fig. 6a
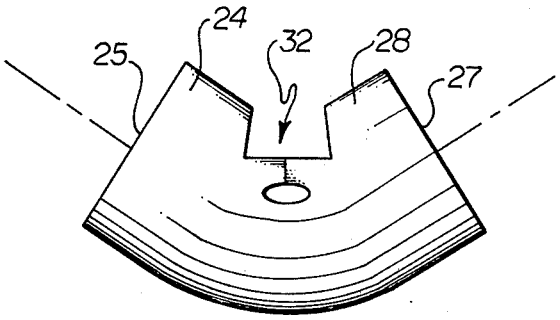
Fig. 6b

ELBOW/KNEE GUARD

BACKGROUND OF THE INVENTION

This invention relates generally to protective equipment for athletes, and more specifically concerns elbow and knee guards.

Protection for an athlete's limbs and joints is important in many sports, but particularly in sports such as basketball, where little other equipment is worn and there is substantial contact between the players and/or the players and the playing surface. Elbow and knee guards in particular have long been used in baseketball, not only to protect against possible injury, but also to prevent aggravation of an already injured limb or joint.

To date, however, elbow and knee guards have comprised either a wrap-around elastic bandage, or a tubular elastic element configured to fit over the joint. Such articles suffer from numerous disadvantages. They provide minimal protection for the joint over which they're positioned, and virtually no protection for the sides of the joint. Further, when a protective pad is used with these articles to increase their protective capability, the mobility of the user is diminished substantially. Such articles are often difficult to keep in place during use, and hence they must be either regularly adjusted, or maintained in place by tape or similar means. Even further, such articles are usually quite uncomfortable, as they tend to be constrictive and to interfere with the natural movement of the joint. They also chafe the skin, particularly when they bunch up in the back of the joint during movement.

Due to these disadvantages, such articles are not used nearly as much as is desirable. Many injuries probably can be avoided if adequate protective equipment is used.

Accordingly, it is a general object of the present invention to provide an improved elbow/knee guard which overcomes one or more of the disadvantages of the prior art mentioned above.

It is another object of the present invention to provide such an elbow/knee guard which is more comfortable to wear than the elbow/knee guards of the prior art.

It is a further object of the present invention to provide such an elbow/knee guard which is configured to conform to the contour of the limb on which it is placed.

It is an additional object of the present invention to provide such an elbow/knee guard which flexes with the movement of the joint but stays in place over the joint without additional restraints such as tape.

It is a still further object of the present invention to provide an elbow/knee guard which results in only a minimal reduction, if any, of the mobility of the user.

SUMMARY OF THE INVENTION

Accordingly, the present invention is an elbow/knee guard which includes a protective pad, a cover which extends around and covers the protective pad, and means holding the combination of the pad and cover on the elbow/knee of the user. The configuration of the protective pad is an important feature of the present invention, as it permits a wide degree of flex of the joint when the article is in place without the pad bunching up in any spot. The pad has two end edges and two longitudinal edges, wherein the longitudinal edges each have a generally keyhold-shaped cut-out portion located substantially intermediate along each longitudinal edge.

DESCRIPTION OF THE DRAWINGS

A more thorough understanding of the invention may be obtained by a study of the following detailed description taken in connection with the accompanying drawings in which:

FIG. 5 is an isometric view of the elbow/knee guard of FIG. 1, showing a collar in exploded relationship thereto.

Figure 1:
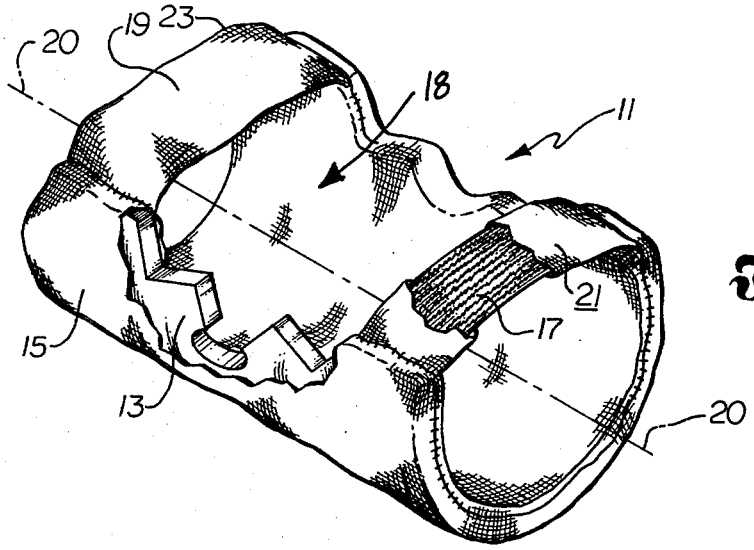
FIG. 1 is an isometric, partially cut-away view of the elbow/knee guard of the present invention.

FIG. **6*a* is a side elevation view of the protective pad portion of the article of FIG. 1** in a relaxed position.

FIG. **6*b* is a side elevational view of the pad of FIG. 6*a*** in a flexed position.

DESCRIPTION OF THE PREFERRED EMBODIMENT

FIG. 1 shows the elbow/knee guard of the present invention. Although the configuration of some of the parts of the article shown and described herein will differ slightly depending on whether it is for use on the elbow or the knee, as will be more clearly explained hereinafter, the general configuration of both articles is as shown in FIG. 1.

The elbow/knee guard is shown generally at 11 and includes a protective pad 13, a cover 15 for the protective pad 13, two elastic strips 17 and 19 which connect the side edges of the combination of pad 13 and cover 15 near the ends thereof, and covers 21 and 23 for the elastic strips.

The elastic strips 17 and 19 are short enough that the combined pad and cover is curved about its longitudinal axis 20—20, so that the article is generally tubular, with an opening 18 defined by the side edges of the combined pad and cover and the interior edges of the elastic strips 17 and 19.

Figure 2:
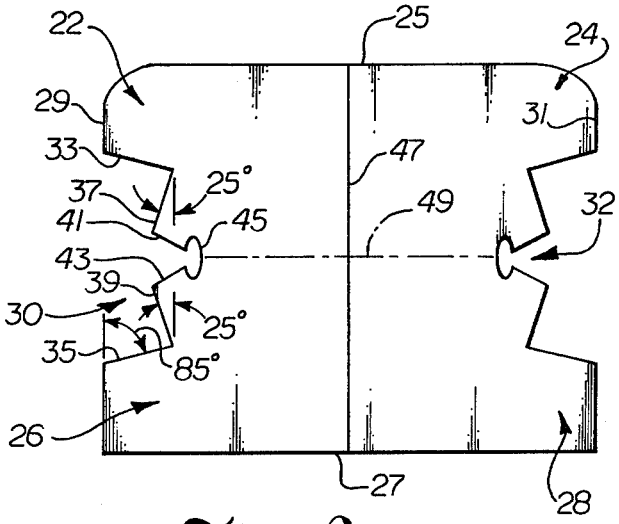
FIG. 2 is a top plan view of the protective pad of the elbow/knee guard of the article of FIG. 1.

FIG. 2 is exemplary of the configuration of the protective pad 13 used in the elbow/knee guard of the present invention. Its size depends upon the desired finished size of the article, while its configuration will depend somewhat upon whether the article is to be used as an elbow or a knee guard. The dimension of the article and its constituent parts are for a size large. The dimensions of other sized articles are adjusted accordingly.

The pad 13 is somewhat wider than it is long, with the pad shown being approximately 7 inches long and 8½ inches wide. The top and bottom edges 25 and 27, respectively, are both substantially straight, although the top edge 25 curves slightly at its ends, as shown, in the knee guard embodiment to mate with the neighboring side edges. This curve at the ends of the top edge prevents the corners from otherwise bulging out during flexing of the knee. In the elbow guard embodiment, the top corners of the pad are square, instead of being rounded.

The two side edges 29 and 31 of pad 13 extend between top and bottom edges 25 and 27. Each side edge 29 and 31 has a substantially central cut-out portion 30 and 32, respectively, which extend inward of the article. In the knee pad shown in FIG. 2, each cut-out portion includes a first pair of edges 33 and 35 which begin (for the large size) at approximately 1¾ inches from the top edge 25 and 1½ inches from the bottom edge, respectively. For the elbow embodiment, the beginning points of the first pair of edges would be substantially equally spaced from the neighboring end edges. The first pair of edges 33 and 35 converge toward each other and inward at an angle of approximately 85° from the vertical, for approximately 1⅛ inches.

A second pair of edges 37 and 39 begin from the end of edges 33 and 35, extending almost directly toward each other and slightly outward at an angle of approximately 25° from the vertical, for a distance of approximately 1 inch (again for the large size). A third pair of edges 41 and 43 begin from the end of edges 37 and 39, and extend slightly toward each other, almost directly inward of the article, at an angle of 60° from the vertical for a distance of approximately ⅝ inch. The ends of edges 41 and 43 are approximately ⅜ inch apart. A ¾ inch, 25° ellipse 45 connects the ends of the third pair of edges, thus giving the combination of the third pair of edges and the ellipse the general appearance of a keyhole.

When the pad 13, configured as shown, is curved about centerline 47, it is possible to further flex the pad about dotted line 49, without distorting the pad, because of the keyhole shaped opening. The rest and flexed positions of a portion of the pad is shown in FIGS. 6*a* and 6*b*, demonstrating how the key-hole-shaped opening permits flexing of the pad without bunching.

The configuration of the side edges as shown results in a pair of matching projections at each end of the article. Projections 22 and 24 are the pair at the top end of the article, while projections 26 and 28 are at the lower end. The projections protect the bones and cartlidge at the sides of the limb, above and below the joint, and stabilize the pad in the cover 15.

Figure 3:
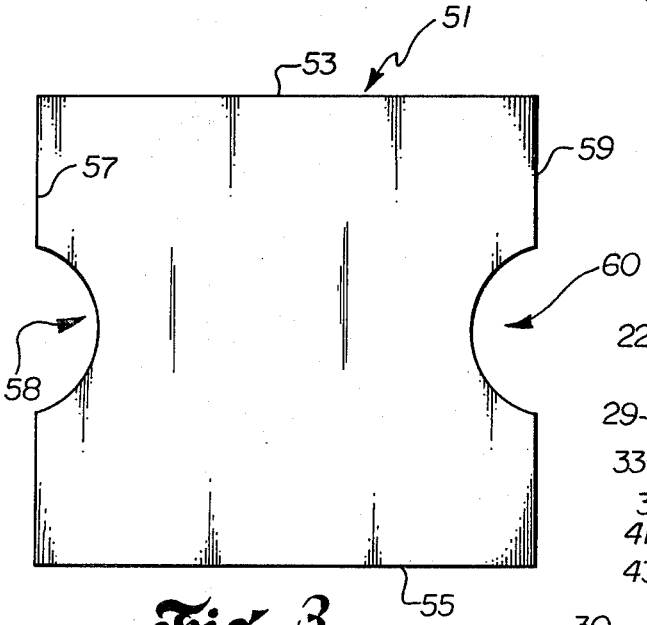
FIG. 3 is a plan view of a half portion of a cover element for the elbow/knee guard of FIG. 1.

FIG. 3 shows a one-half portion of the cover for the pad 13. The one-half portion or cover piece 51 is preferably made from a stretchable fabric, such as stretchable nylon. The cover piece 51 shown is for use with the pad of FIG. 2, and is 8¾ inches wide by 8⅜ inches long. When pad 13 is properly positioned relative to cover piece 51, top edge 53 of cover piece 51 is adjacent top edge 25 of pad 13, and bottom edge 55 is adjacent bottom edge 27 of the pad, while side edges 57 and 59 are adjacent side edges 29 and 31 of pad 13, respectively.

The top and bottom edges 53 and 55 of cover piece 51 are substantially straight, while side edges 57 and 59 have concave cut-out portions 58 and 60 midway along their lengths. Cut-out portions 58 and 60 are each approximately 3 inches long and 1 inch deep at their deepest points. Two identical cover pieces 51, attached along their respective mating edges, using stretchable thread preferably, form the cover 15 for the protective pad 13.

Figure 4:
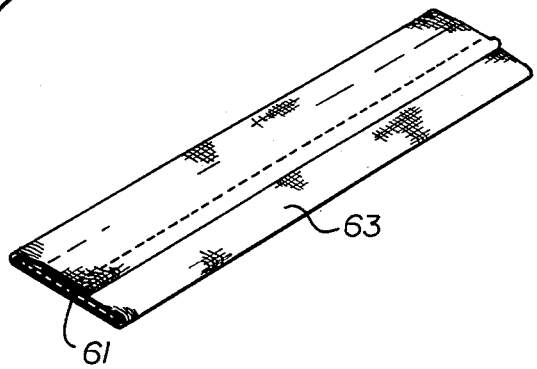
FIG. 4 is an isometric view showing the combination of one elastic strap and its associated cover.

Referring now to FIG. 4, two strips of elastic material 61, which have approximately the same width, respectively, as each pair of projections of pad 13, are provided to complete the article. A cover 63 of the same stretch material as cover piece 51 is used to cover each elastic strip. The cover 63 is slightly greater than twice the width of the elastic strip it is used with, and about ¼ inch longer than its length, to permit attachment of the covered strips to the combined pad and cover. Although the article is shown with two elastic strips 17 and 19 with their respective covers 21 and 23 made of stretchable material, in some cases, the elastic strips may be eliminated.

In one method of construction, two identical cover pieces 51 are laid on top of each other, wrong surface out, with one end of each covered elastic strip intermediate the two cover pieces at the projections along a first side of each cover piece. The first sides of the two cover pieces are sewn together, and then the mating bottom edges of the cover pieces are sewn. The covered elastic strips are then stretched to meet the matching projections on the second sides of the two cover pieces, and these sides are then sewn together. The article is then turned inside out, and the pad 13 is then inserted through the open top. The mated top edges of the cover pieces are then sewn together, resulting in an article which presents a clean, attractive appearance, with the pad and two elastic strips being completely covered by the cover material.

The two elastic strips 17 and 19 (FIG. 1) may have different lengths so that the opening at one end of the article is slightly greater than the opening at the other end. Conceivably, however, this result may be accomplished in other ways, such as by using elastic strips of different elasticity. The strips 17 and 19 may also have different widths, to match projections of different widths. The article is placed on the limb so that the end with the larger opening is on a large muscle, i.e., the thigh or the upper arm, above the joint, and the end with the smaller opening is below the joint. In some applications, this arrangement is important, as it substantially improves the stability of the article on the limb.

The article is held tightly about the limb below the joint. This is the control point of the article, as there is relatively little change in the circumference of the limb below the joint during exercise. The large limb muscles, i.e., the thigh and upper arm muscles, do however, substantially change size during exercise, and hence, the article is held somewhat looser above the joint. The article of the present invention can thus accommodate changes in the circumference of the limb above the joint during exercise, without affecting the stability of the article on the limb, because the control point of the article is below the joint, where changes in limb circumference are not large.

If necessary, a collar 70, as shown in FIG. 6, may be added to the lower end of the article to assist in stabilizing the article on the limb. The collar 70 is a rectangular piece of cover material, similar to the cover materials for the pad and the elastic strips, having a length slightly greater than the circumference of the article and a width of approximately 2½ inches, again for a large size article.

In construction, the rectangular piece is first doubled over and then sewn together along its end edges to form a circle. The free circular edges 72 of the collar are then sewn, preferably by a surge stitch, to the lower end of the article, i.e., the end having the smaller opening. Although collar 70 does provide some additional control for the article, it is not critical to its operation.

The article shown and described when properly positioned, tends to remain in place on the user's limb, without the need for tape or other securing means, even during extreme movement of the limb. The article provides a considerable amount of protection for the joint, as the protective pad covers both the joint itself, and the cartilage and bone on both sides of the limb, both above and below the joint.

By virtue of the novel configuration of the protective pad, the article is capable of flexing through a large angle without bulging, so that it adheres to the outline of the limb even when the limb is in various extreme positions, without buckling or bulking up in any spot.

Additionally, the article is comfortable to wear, primarily because the back of the article is open, thereby eliminating the bulking up of material in the back of the joint, as is the case generally with prior art elbow and knee guards. The main points of firm contact between the elbow/knee guard of the present invention and the joint on which it is positioned are through the elastic strips, positioned above and below the joint. In practice, the presence of these elastic strips has not proven to be either too restrictive or uncomfortable for the user. Since one elastic strip is slightly shorter than the other, the end openings for insertion of the limb are different sizes. The smaller opening is for below the joint and the corresponding end is the control point for the article on the limb. This arrangement increases the comfort of the device, without in any way interfering with the stability of the article.

Hence, a novel elbow/knee guard has been disclosed which provides better protection and increased comfort over existing elbow/knee guards, and which does not interfere substantially with the natural movement of the user. A preferred embodiment of the invention has been disclosed herein for purposes of illustration of the invention and it should be understood that various changes, modifications and substitutions may be incorporated in the embodiment shown without departing from the spirit of the invention, which is defined by the claims which follow.

What is claimed is:

1. An elbow/knee guard for use in athletics comprising:

a protective pad of resilient material having in outline two end edges joined by two longitudinal edges, said pad being sufficient in area and sufficiently flexible to cover the front part of the knee joint/-outer part of the elbow joint, and the immediate surrounding area, but not the remainder of the joint, said longitudinal edges in said pad each having a cutout portion substantially intermediate thereof, wherein each cutout portion includes first and second cutout sections, the first cutout section being generally rectangular in shape and extending over approximately one-half of the length of the article and inward of the article approximately one-sixth of the width thereof, the second cutout section being generally keyhole-shaped and extending further inward of the article from said first cutout section about a line which is approximately midway between said two end edges, such that when said pad is curved about its longitudinal axis, as it is when the guard is in place on an elbow/-knee, said pad may be flexed through a substantial arc about a line passing through the center of the cutout portions without distorting substantially said pad;

a cover which extends around and covers said pad and conforms substantially to the outline of said pad, forming a combination of said pad and said cover, wherein said combination is sufficiently wide that portions thereof cover portions of the limb on which the article is positioned above and below the joint; and elastic strip means located at both longitudinal ends of the combination, extending between and secured to the longitudinal edges thereof, for maintaining said combination securely on the elbow/knee of the user during vigorous movement of the user, such as in athletic contests.

2. An article of claim 1, wherein one elastic is somewhat shorter than the other so that the opening formed by said one strip and the neighboring end of said combination is less than the opening formed by said other strip and the neighboring end of said combination.

3. An article of claim 1, wherein each longitudinal edge of said pad includes two wing-like projections, wherein each projection extends longitudinally of said pad from an end edge of said pad to a point along the longitudinal edge of which it is a part approximately one-quarter of the length of the longitudinal edge, to the cutout portion in that longitudinal edge.

4. An article of claim 1, wherein each longitudinal edge has the following configuration: first and second portions extending substantially perpendicular to said end edges, respectively, of the article, said first and second portions each covering approximately one-quarter of the total length of each longitudinal edge and terminating in free ends thereof; third and fourth portions which extend inwardly of the pad from the free ends of said first and second portions, said third and fourth portions tapering at a slight angle toward each other and terminating in free ends thereof; fifth and sixth portions which extend from the free ends of said third and fourth portions toward each other but slightly back to the neighboring longitudinal edge, terminating in free ends thereof; and a seventh portion which joins the two free ends of said fifth and sixth portions, said seventh portion being generally in the shape of a keyhole having a base portion and an upper portion, wherein the base portion is somewhat wider at its bottom then at its top, said third, fourth, fifth, sixth and seventh portions defining the outline of said cutout portion.

5. An article of claim 1, wherein said end edges are substantially straight.

6. An article of claim 1, wherein said protective pad comprises a resilient material.

7. An article of claim 1, including a collar which is secured to one end of said combination.

8. An article of claim 1, wherein said elastic strip means are configured so that the combination is drawn into a curve about the longitudinal axis thereof, leaving an opening defined by opposing portions of the longitudinal edges of said combination and the inside edges of said elastic strip means.

* * * * *

UNITED STATES PATENT AND TRADEMARK OFFICE

CERTIFICATE OF CORRECTION

PATENT NO. 4,198,708

DATED : April 22, 1980

INVENTOR(S) : Albert L. Fugere and Michael J. Kelly

It is certified that error appears in the above-identified patent and that said Letters Patent are hereby corrected as shown below:

Claim 2, line 1, the word --strip-- should be inserted after the word "elastic".

Signed and Sealed this

*Twelfth* Day of *August 1980*

[SEAL]

*Attest:*

SIDNEY A. DIAMOND

*Attesting Officer*

*Commissioner of Patents and Trademarks*